US008444386B1

(12) United States Patent
Liang

(10) Patent No.: US 8,444,386 B1
(45) Date of Patent: May 21, 2013

(54) TURBINE BLADE WITH MULTIPLE NEAR WALL SERPENTINE FLOW COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 593 days.

(21) Appl. No.: 12/689,280

(22) Filed: Jan. 19, 2010

(51) Int. Cl.
*F01D 5/18* (2006.01)

(52) U.S. Cl.
USPC ..... 416/92; 416/97 R

(58) Field of Classification Search
USPC ..... 415/115, 116; 416/95, 96 R, 97 R, 416/92
See application file for complete search history.

(56) References Cited

U.S. PATENT DOCUMENTS

| | | | | |
|---|---|---|---|---|
| 5,813,835 | A * | 9/1998 | Corsmeier et al. | 416/97 R |
| 2002/0164250 | A1 * | 11/2002 | Chung et al. | 416/97 R |
| 2009/0028702 | A1 * | 1/2009 | Pietraszkiewicz et al. | 416/1 |
| 2009/0232661 | A1 * | 9/2009 | Ryznic | 416/97 R |

* cited by examiner

*Primary Examiner* — Edward Look
*Assistant Examiner* — William Grigos
(74) *Attorney, Agent, or Firm* — John Ryznic

(57) ABSTRACT

An air cooled turbine blade with a number of multiple pass serpentine flow cooling circuits extending around the airfoil surface in which a first leg of each serpentine flow circuit is located against a hot wall surface and the second legs and even the third legs of the serpentine flow circuits being located inward from the first legs. The circuits include two-pass serpentine circuits in the leading edge and trailing edge region that discharge into collection cavities, and the mid-chord section of the airfoil is cooled with three-pass serpentine circuits that discharge into long slots that open onto the blade tip.

17 Claims, 8 Drawing Sheets

View A-A

TURBINE BLADE WITH MULTIPLE NEAR WALL SERPENTINE FLOW COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically for an air cooled turbine blade.

2. Description of the Related Art Including Information Disclosed Under 37 CFR 1.97 and 1.98

A gas turbine engine, such as an industrial gas turbine (IGT) engine, includes a turbine with one or more stages or stator vanes and rotor blades that react with a hot gas stream and produce mechanical work. The first stage airfoils (vanes and blades) are exposed to the highest temperature gas flow and therefore require the most cooling. In order to allow for higher turbine inlet temperatures—and therefore higher engine efficiencies—better cooling is required if material properties are not advanced enough. Also, since the airfoil cooling air is typically bled off from the compressor, the cooling air used does not contribute to producing any work in the engine. It is a design objective to not only provide for better cooling capability, but also to use a minimal amount of cooling air to higher efficiency.

FIG. 1 shows a first stage blade external pressure profile. A forward region of the leading edge and the pressure side surface experiences a high hot gas static pressure while the entire suction side of the airfoil is at a much lower hot gas static pressure than on the pressure wall side. Thus, a near wall serpentine flow blade cooling design can be divided into four zones: 1) the blade leading edge region, 2) the blade pressure side section, 3) the blade suction side section, and 4) the blade trailing edge region. Each individual cooling zone can be independently designed based on the local aerodynamic pressure loading conditions. dividing the airfoil into these four zones increases a design flexibility to redistribute cooling flow and/or add cooling flow for each zone and therefore increase a growth potential (use the similar design for larger airfoils) for the cooling design. Also, individual serpentine flow circuits used in each zone can further enhance the flexibility of the cooling flow distribution. With this design approach, a more uniform temperature distribution for the airfoil mid-chord section can be achieved. A uniform temperature distribution will reduce hot spots from appearing on the airfoil that causes erosion and short blade life.

FIG. 2 shows a first stage blade external heat transfer coefficient profile. The airfoil leading edge, the suction side immediately downstream from the leading edge, and the airfoil trailing edge region experiences the higher hot gas side external heat transfer coefficient than does the mid-chord section of the pressure side and downstream of the suction side. The heat load for the airfoil aft section is higher than the forward section. This heat load distribution can also be subdivided into four zones as in the above described pressure profile of FIG. 1. Individual zones can then be designed based on the local heat load to achieve a uniform metal temperature distribution profile. Different cooling channel size for each zone can be used to adjust for the required cooling flow rate to achieve the metal temperature level.

BRIEF SUMMARY OF THE INVENTION

An air cooled turbine airfoil, such as a rotor blade, includes many near wall radial extending serpentine flow cooling circuits along the walls of the airfoil from the leading edge to the trailing edge, where each serpentine flow cooling circuit includes a first leg or channel located against the hot surface of the airfoil wall, and the second or third legs or channels are located inward from the first leg. The leading edge region and the trailing edge region are cooled with two-pass serpentine flow cooling circuits while the mid-chord section on the pressure and suction wall sides are cooled using three-pass serpentine flow cooling circuits. The second leg of the three-pass serpentine circuit is located offset to one side from a line extending between the first and third legs. The serpentine flow circuits are thus perpendicular to the heat load on the airfoil surface and thus creates more frontal cooler serpentine flow channels for the near wall cooling design than in the prior art parallel or counter flow serpentine flow circuits.

The three-pass serpentine circuits include a third leg that flows radially upward and discharges into a common pressure wall side slot or common suction wall side slot both formed on the blade tip within a squealer pocket. The leading edge and trailing edge region serpentine circuits include a second leg that flows into a collector cavity located in the leading edge region and the trailing edge region, where the collector cavities discharge the cooling air onto the blade tip.

DETAILED DESCRIPTION OF THE INVENTION

Figure 1:
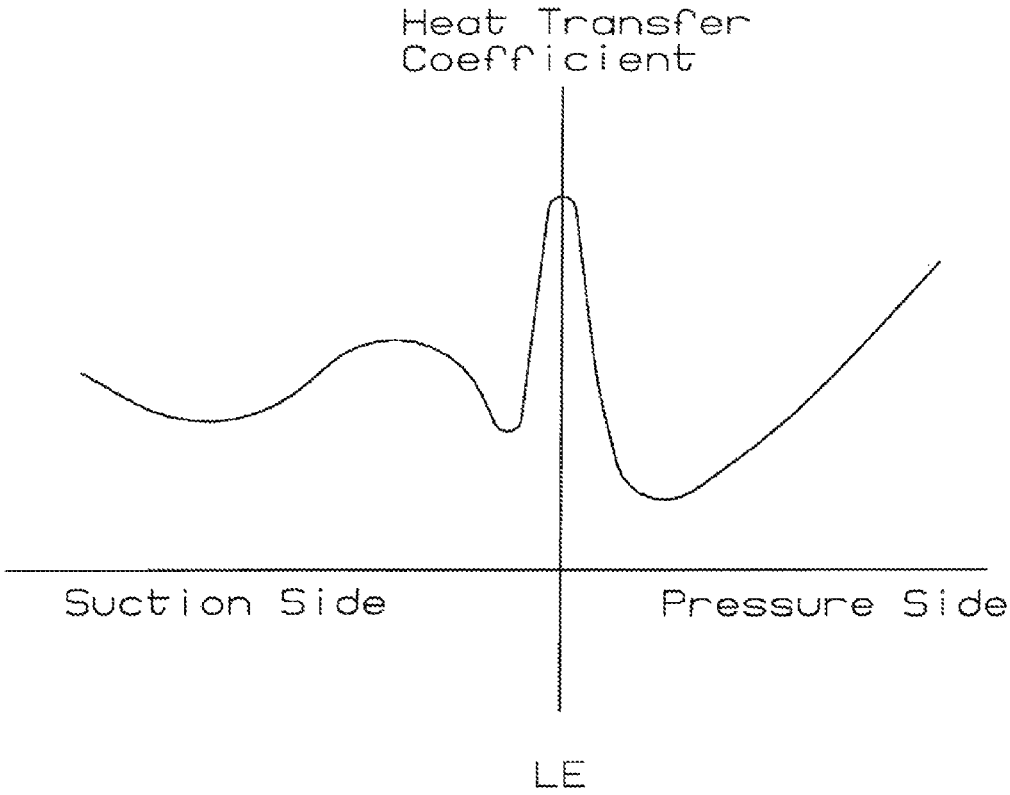
Fig 1 Prior Art
FIG. 1 shows an external heat transfer coefficient profile for a first stage turbine blade.
Figure 2:
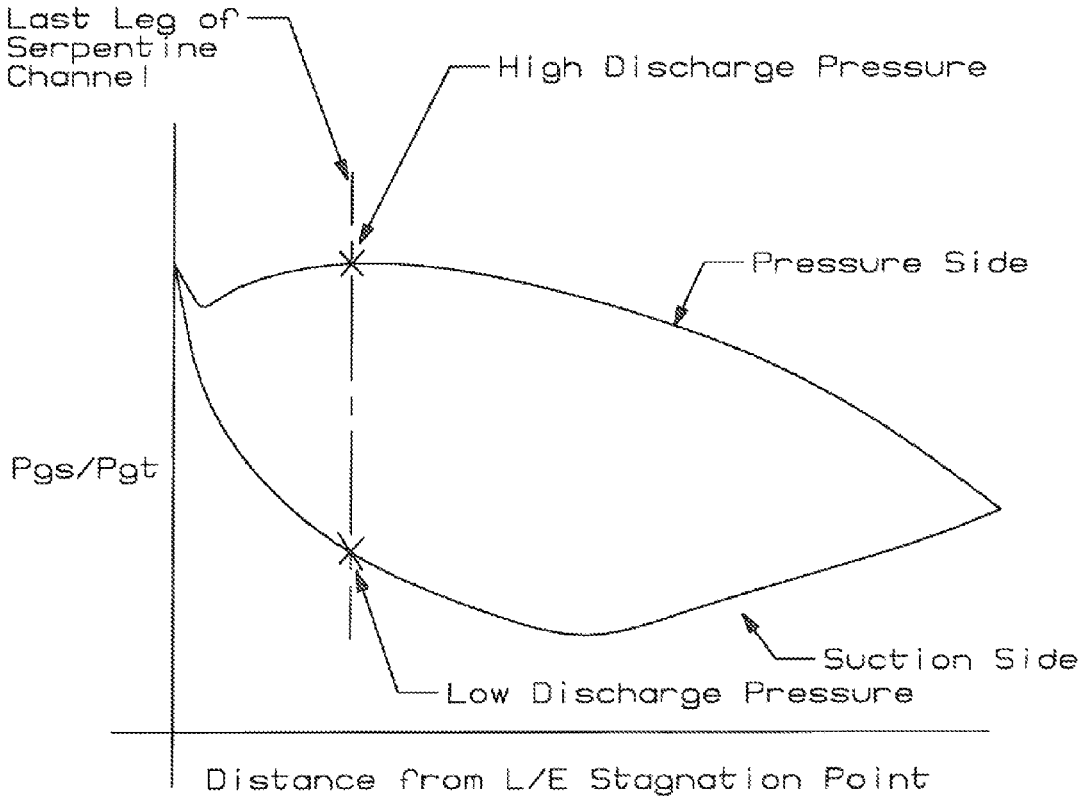
Fig 2 Prior Art
FIG. 2 shows an external pressure profile for a first stage turbine blade.
Figure 3:
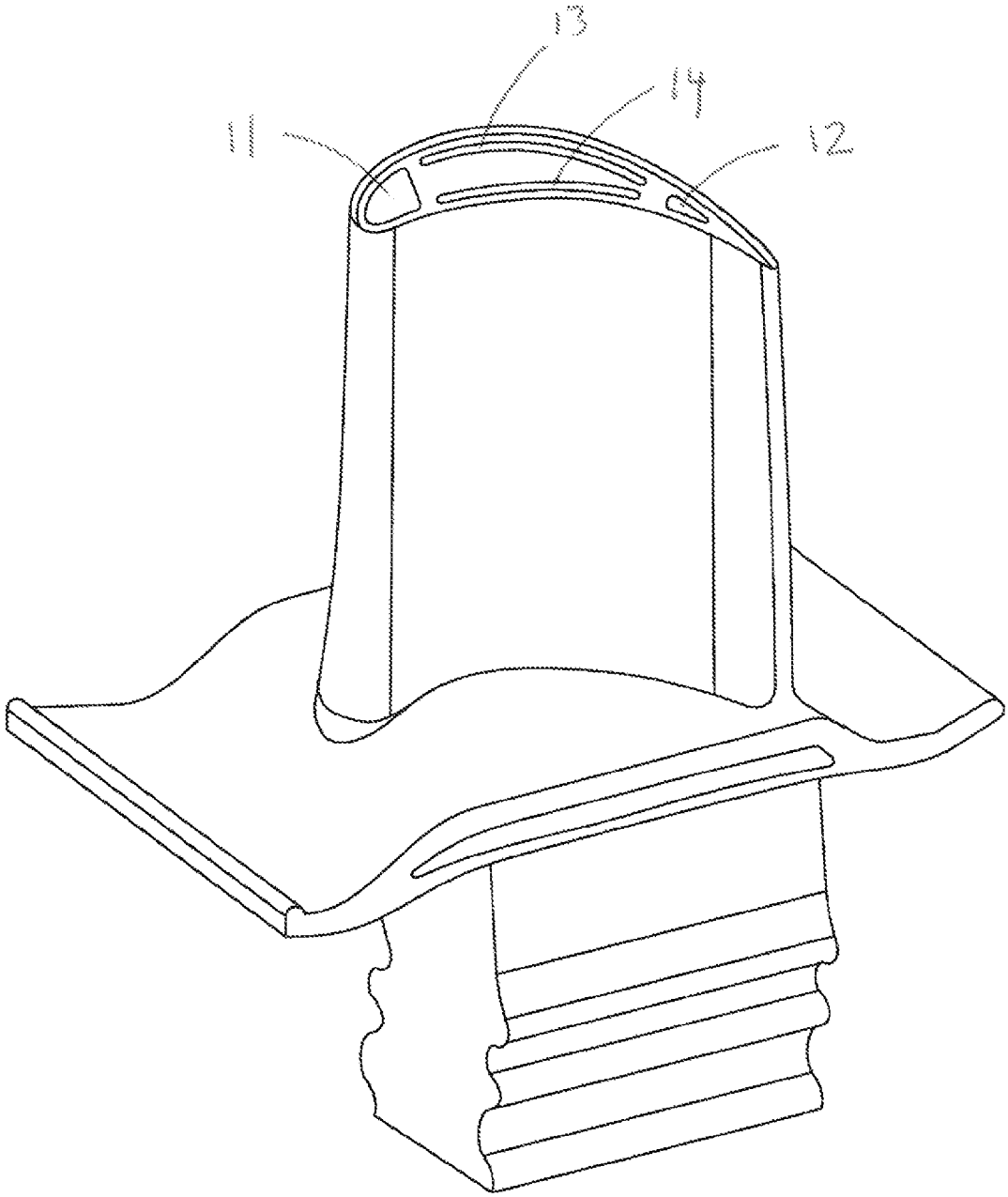
FIG. 3 shows a schematic view of a turbine blade with the serpentine flow cooling circuits of the present invention.

A turbine blade for a gas turbine engine, especially for an industrial gas includes a number of two-pass and three-pass serpentine flow cooling circuits each arranged perpendicular to a hot heat load on the airfoil surface. FIG. 3 shows the blade with a blade tip having a leading edge collection cavity 11 and a trailing edge region collection cavity 12 both opening onto the blade tip within a squealer pocket formed by tip rails extending around the blade tip periphery. A suction wall side discharge slot 13 opens onto the blade tip within the squealer pocket, and a pressure wall side discharge slot 14 opens onto the blade tip also within the squealer pocket. Both slots 13 and 14 extend from adjacent to the LE and T/E collection cavities 11 and 12.

Figure 4:
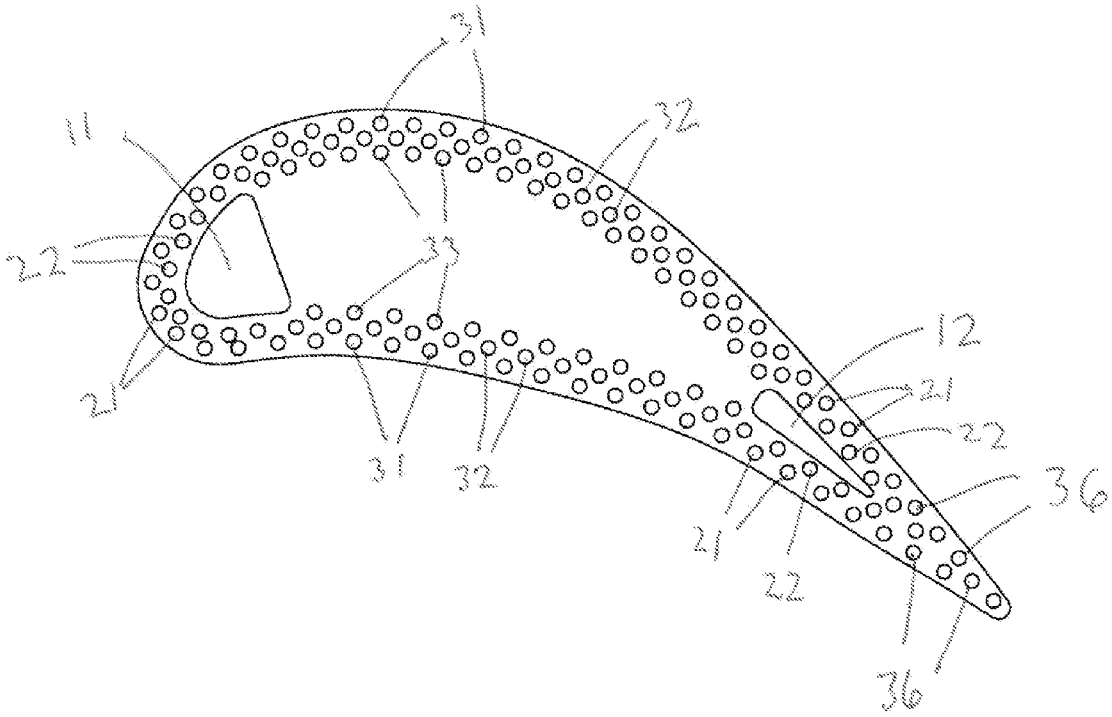
FIG. 4 shows a cross section view along the radial direction of the blade of FIG. 3.

FIG. 4 shows a cross section view of the blade and the serpentine flow cooling circuits of the present invention. The L/E collection cavity is formed within the leading edge region of the airfoil, and the T/E collection cavity 12 is formed in the trailing edge region. Both cavities 11 and 12 extend the full radial (spanwise) length of the airfoil section of the blade, which is from the platform to the blade tip. A number of two-pass serpentine flow cooling circuits with a first leg or channel 21 and a second leg 22 is formed within the leading edge region between the L/E surface and the L/E collection cavity 11. Both legs 21 and 22 are radial extending channels. The first leg 12 is located adjacent to the hot wall surface of the L/E region airfoil surface with the second leg 22 located inward and closer to the collection cavity 11.

The trailing edge region is also cooled with two-pass serpentine flow cooling circuits that include a first leg 21 located against the hot wall surface and a second leg 22 located inward and closer to the collection cavity 12. The second legs 22 of the two-pass serpentine circuits discharge into the respective collection cavity 11 or 12. Two-pass serpentines flow cooling circuits are used in the L/E and T/E regions because of the shorter spacing between the collection cavity and the airfoil surface.

The airfoil mid-chord section—the airfoil section that extends between the L/E region and the T/E region—is cooled with three-pass serpentine flow cooling circuits each having a first leg or channel 31 located against the hot wall surface, a second leg 32 located inward from the first leg 31, and a third leg 33 located inward from the second leg 32. This forms a serpentine flow cooling circuit that is arranged perpendicular to the hot was surface. In this embodiment, the second leg 32 of the three-pass serpentine circuit is also offset to one side from the first leg 31 and the third leg 33 so that the three legs or channels can be located closer together.

The first legs 21 and 31 of the two-pass and the three-pass serpentine flow circuits are all located against the hot wall surface and are supplied with cooling air form a cooling air supply cavity located within the blade. With this design, all of the first legs 21 and 31 are supplied with fresh cooling air and flow against the hot wall surface to provide a maximum amount of convection cooling.

Figure 5:
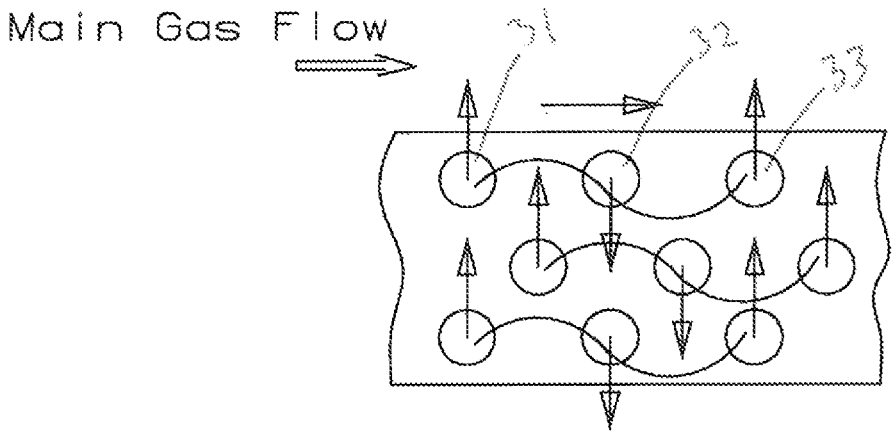
FIG. 5 shows a near wall serpentine flow cooling design for a parallel flow circuit to a main gas flow direction.
Figure 6:
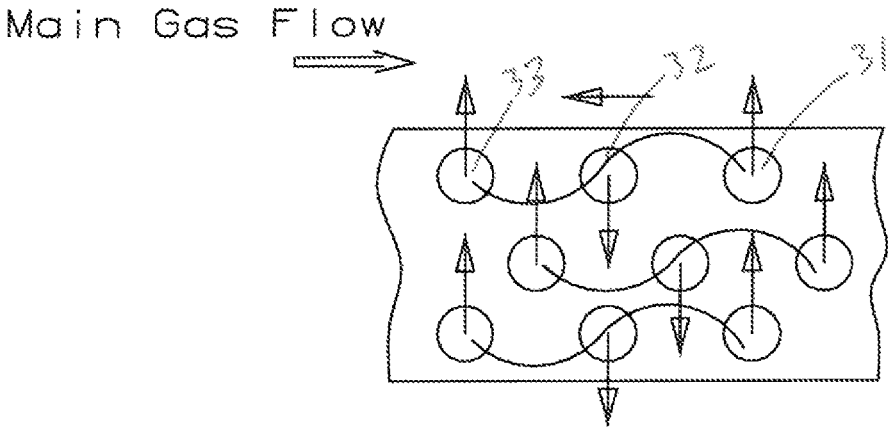
FIG. 6 shows a near wall serpentine flow cooling design for a counter flow circuit to the main gas flow.

FIG. 5 shows an embodiment with three-pass serpentine flow cooling circuits arranged in a parallel flow direction with the main gas flow. The three-pass serpentine circuits are parallel to the main gas flow so that in one of the circuits, all of the legs 31-33 are located against the hot gas surface. FIG. 6 shows a three-pass serpentine circuit that is counter flowing to the main gas flow where the serpentine flow circuit flows counter (opposite direction) to the main gas flow. Like the FIG. 5 arrangement, one of the serpentine circuits includes all three legs 31-33 against the hot wall surface.

Figure 7:
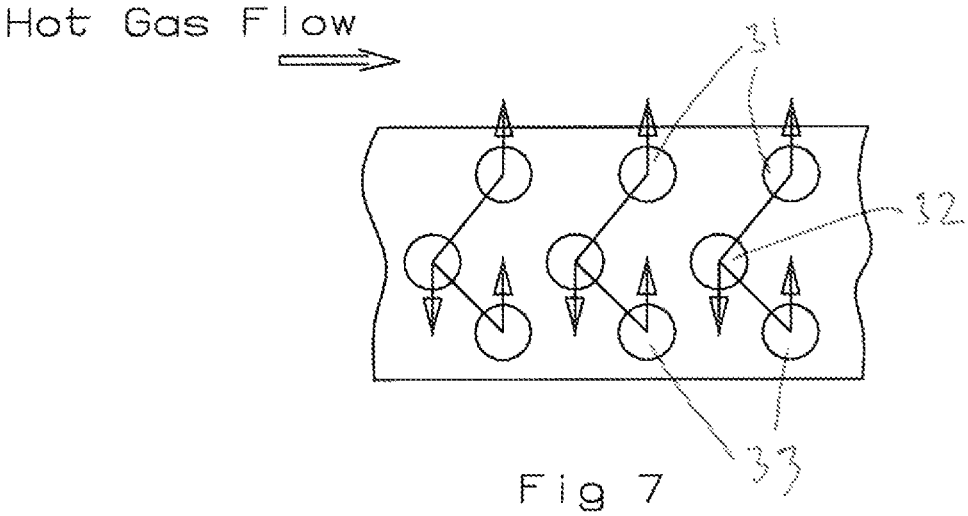
FIG. 7 shows a near wall serpentine flow cooling design with the serpentine circuits perpendicular to the main gas flow.

The first embodiment of the present invention is shown in FIG. 7 in which all of the three-pass serpentine circuits are perpendicular to the hot wall surface and in which all of the first legs 31 are located against the hot wall surface. In this design, the hot wall surface is cooled with fresh cooling air in all of the serpentine circuits.

Figure 8:
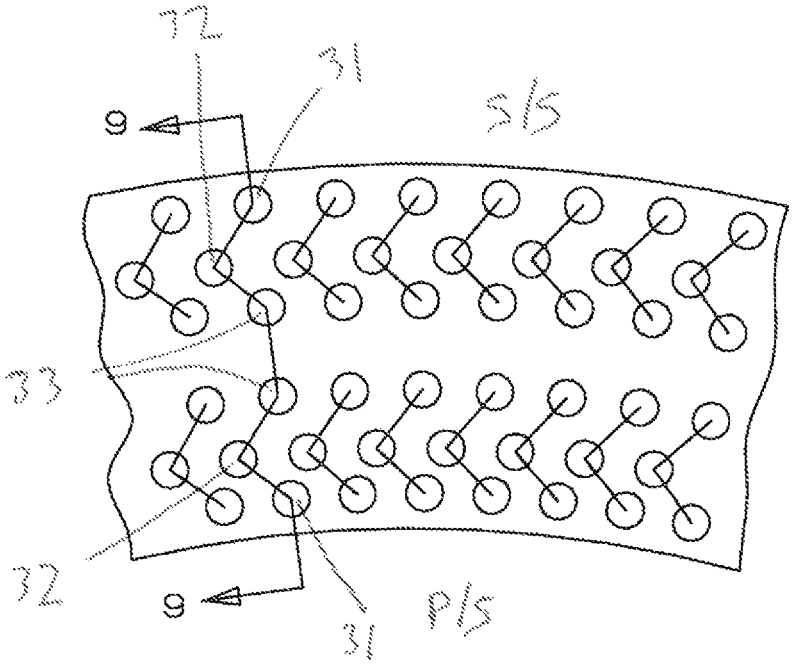
FIG. 8 shows a cross section view along the radial direction of a section of a wall of the blade in the present invention.
Figure 9:
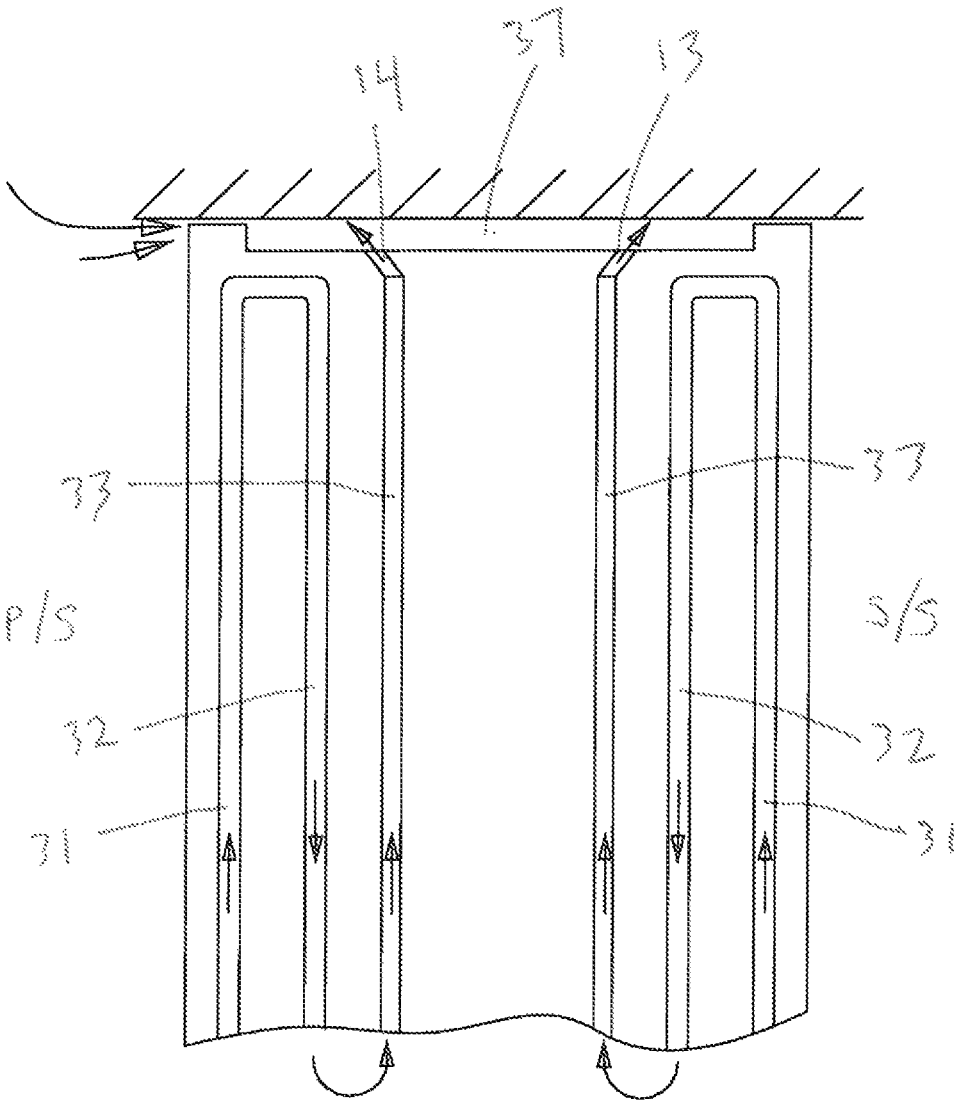
FIG. 9 shows a cross section view of the blade cooling circuit through the line in FIG. 8.

FIG. 8 shows a cross section detailed view of a section of the wall of the airfoil with a P/S wall on the bottom of this figure and a S/S wall on the top. A number of three-pass serpentine flow cooling circuits are formed in the walls with the first legs 31 all located against the hot wall surface and the second legs 32 located inward and offset toward one side, and the third leg 33 located inward to form a line with the first leg 31 that is perpendicular to the hot wall surface. FIG. 9 shows a cross section view through the line in FIG. 8. The P/S wall is on the left side and the S/S wall is on the right side of this figure. The first legs 31 are located against the hot wall surface, the second leg 32 is located inward with a turn from the first leg 31 at the tip region, and the third leg 33 is inward of the second leg 32 with a turn at the platform section. The P/S discharge slot 14 is located on the pressure wall side of the squealer pocket 37 and discharges the cooling air from the third legs 33 of all the three-pass serpentine circuits along the P/S wall. The third legs 33 for the S/S serpentine circuits all discharge into the S/S discharge slot 13.

Figure 10:
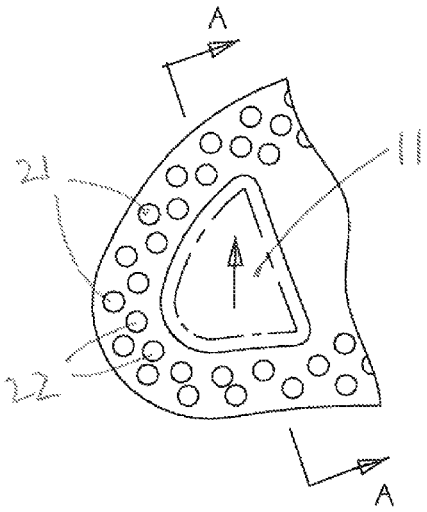
FIG. 10 shows a detailed view of the serpentine circuit in the leading edge region of the blade in FIG. 3.
Figure 11:
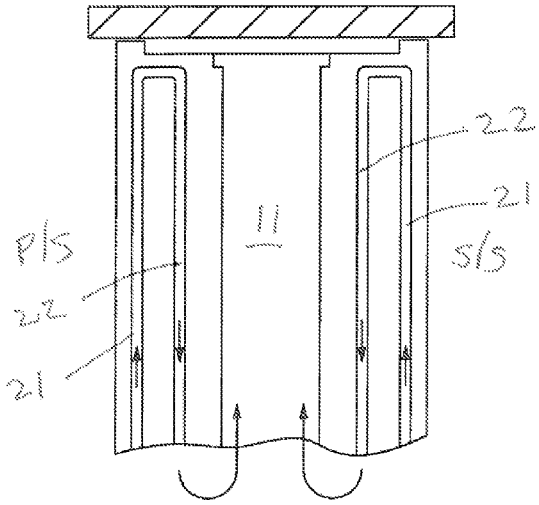
FIG. 11 shows a cross section view of the leading edge cooling circuit through line A-A in FIG. 10.

FIG. 10 shows a cross section detailed view of the leading edge region cooling circuits with the collection cavity 11 located in the L/E region and the two-pass serpentine circuits spaced around the L/E wall and between the L/E surface and the collection cavity 11. The first legs 21 are located against the airfoil hot wall surface and the second legs 22 are locate inward closer to the collection cavity 11. The second legs 22 all discharge into the collection cavity 11. FIG. 11 shows a cross section view through the line A-A in FIG. 10. The first leg 21 turn into the second leg 22 adjacent to the blade tip and the second leg 22 turns into the collection cavity 11 in the platform region. The collection cavities 11 and 12 are required since only two passes are used in these regions and the first leg 21 flows upward toward the blade tip.

Figure 12:
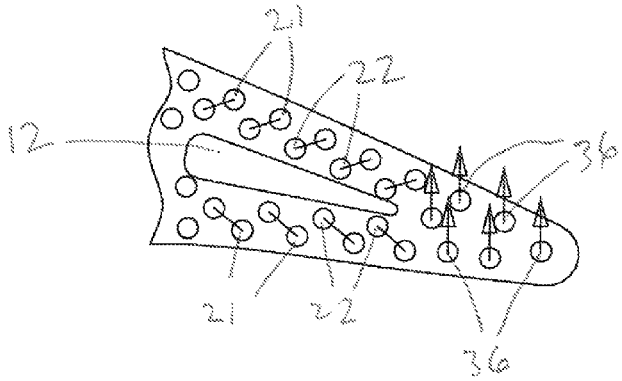
FIG. 12 shows a detailed view of the serpentine circuit in the trailing edge region of the blade in FIG. 3.

FIG. 12 shows a cross section detailed view of the trailing edge region cooling circuit with the T/E collection cavity formed between the P/S wall and the S/S wall. Two-pass serpentine circuits are formed between the walls and the collection cavity 12 with the first legs 21 all located against the hot wall surface and the second legs 22 all located inward and closer to the collection cavity 12. In the thinner T/E section, the radial cooling channels 36 are all single pass radial cooling channels and discharge out through the blade tip. The airfoil is too thin to form multiple pass serpentine in this section.

In each of the radial channels of the serpentine circuits, turbulence promoters such as full circular trip strips can be formed along the channel walls to promote heat transfer from the hot metal channels to the passing cooling air. As the cooling air flows through the serpentine circuits, the cooling air is heated up so that the cooling air passing through the last legs will function to heat up the metal surrounding the last legs. This creates a more thermally balanced airfoil sectional metal temperature so that a lower thermal induced stress and a longer blade life can be achieved. The perpendicular serpentine flow cooling circuits will maximize the use of cooling to the main stream gas side pressure potential as well as tailoring the airfoil external heat load at one particular chordwise location. the spent cooling air form the airfoil mid-chord sections through the slots is discharged into the blade tip squealer pocket and forms a double air curtain for the cooling and sealing of the blade tip portion. In the airfoil leading edge and trailing edge regions, the collector cavities for the third legs are used to discharge the spent cooling air at the middle of the collection cavity.

I claim the following:

1. An air cooled turbine blade comprising:

a leading edge region with a leading edge cooling air collection cavity;

a trailing edge region with a trailing edge cooling air collection cavity;

a mid-chord section with a pressure side wall and a suction side wall;

a plurality of two-pass serpentine flow cooling circuits formed in a wall of the leading edge region and the walls of the trailing edge region;

a plurality of three-pass serpentine flow cooling circuits formed in the pressure side and the suction side walls of the mid-chord section; and, the first legs of each of the two-pass and three-pass serpentine flow cooling circuits are located against a hot wall surface with the second legs and third legs located inward from the first legs.

2. The air cooled turbine blade of claim 1, and further comprising:

the second legs of the three-pass serpentine circuits are offset from the first and third legs.

3. The air cooled turbine blade of claim 1, and further comprising:

The legs of the two-pass and three-pass serpentine circuits are all parallel to the hot wall surface of the airfoil.

4. The air cooled turbine blade of claim 1, and further comprising:

the second legs of the two pass serpentine circuit discharge cooling air into the respective collection cavity; and, the leading edge and the trailing edge collection cavities open onto a blade tip.

5. The air cooled turbine blade of claim 1, and further comprising:

a blade tip with a pressure wall side cooling air discharge slot and a suction wall side discharge slot; and, all of the third legs of the three-pass serpentine circuits discharge into the discharge slots.

6. The air cooled turbine blade of claim 5, and further comprising:

the blade tip includes a squealer pocket; and, the discharge slots open into the squealer pocket.

7. The air cooled turbine blade of claim 5, and further comprising:

the discharge slots extend from the leading edge region to the trailing edge region.

8. The air cooled turbine blade of claim 1, and further comprising:

the legs of the two-pass and three-pass serpentine circuits are radial channels that extend from near to a platform region of the blade to a blade tip region.

9. The air cooled turbine blade of claim 1, and further comprising:

the first legs of the two-pass and three-pass serpentine circuits flow toward the blade tip.

10. An air cooled turbine airfoil comprising:

an airfoil surface exposed to a hot gas flow to form a hot wall surface;

a plurality of multiple pass serpentine flow cooling circuits each having a first leg located against the hot wall surface; and, a second leg connected to the first leg, the second leg being located inward from the first leg.

11. The air cooled turbine airfoil of claim 10, and further comprising:

the second leg is offset from a perpendicular line from the first leg and the airfoil surface.

12. The air cooled turbine airfoil of claim 11, and further comprising:

a third leg located inward from the second leg and along the perpendicular line through the first leg.

13. An air cooled turbine airfoil comprising:

a leading edge region and a trailing edge region;

a pressure side wall and a suction side wall;

a leading edge cooling air collection cavity;

a trailing edge cooling air collection cavity;

a pressure side cooling air discharge slot opening onto a blade tip region;

a suction side cooling air discharge slot opening onto a blade tip region;

a first serpentine flow cooling circuit located in the leading edge region with a last leg that discharges into the leading edge collection cavity;

a second serpentine flow cooling circuit located in the pressure side wall with a last leg that discharges into the pressure side cooling air discharge slot;

a third serpentine flow cooling circuit located in the suction side wall with a last leg that discharges into the suction side cooling air discharge slot; and, a fourth serpentine flow cooling circuit located in the trailing edge region with a last leg that discharges into the trailing edge cooling air collection cavity.

14. The air cooled turbine airfoil of claim 13, and further comprising:

the first and fourth serpentine flow cooling circuits are both two-pass serpentine flow cooling circuits; and, the second and third serpentine flow cooling circuits are both three-pass serpentine flow cooling circuits.

15. The air cooled turbine airfoil of claim 13, and further comprising:

the pressure side cooling air discharge slot and the suction side cooling air discharge slot both extend from the leading edge region to the trailing edge region.

16. The air cooled turbine airfoil of claim 13, and further comprising:

the first leg of each of the first and second and third and fourth serpentine flow cooling circuits are located adjacent to an external surface of the airfoil.

17. The air cooled turbine airfoil of claim 13, and further comprising:

the airfoil is a rotor blade; and, the first and second and third and fourth serpentine flow cooling circuits all extend from a platform section to a blade tip section of the rotor blade.

* * * * *